US008897675B2

(12) United States Patent
Liu et al.

(10) Patent No.: US 8,897,675 B2
(45) Date of Patent: Nov. 25, 2014

(54) SEMI-CONTACT BIAS CHARGE ROLLER

(71) Applicant: Xerox Corporation, Norwalk, CT (US)

(72) Inventors: Yu Liu, Mississauga (CA); Johann E. Junginger, Toronto (CA); Gregory M. McGuire, Oakville (CA); Vladislav Skorokhod, Mississauga (CA); Sarah J. Vella, Milton (CA)

(73) Assignee: Xerox Corporation, Norwalk, CT (US)

( * ) Notice: Subject to any disclaimer, the term of this patent is extended or adjusted under 35 U.S.C. 154(b) by 58 days.

(21) Appl. No.: 13/850,631

(22) Filed: Mar. 26, 2013

(65) Prior Publication Data

US 2014/0294424 A1 Oct. 2, 2014

(51) Int. Cl.
*G03G 15/02* (2006.01)
*G03G 15/00* (2006.01)

(52) U.S. Cl.
CPC ..... *G03G 15/80* (2013.01); *G03G 15/0233* (2013.01)
USPC ..... 399/176; 399/89; 399/174

(58) Field of Classification Search
CPC ..... G03G 15/0208; G03G 15/0233; G03G 15/025; G03G 15/0275; G03G 15/0266; G03G 2215/021; G03G 2215/025
USPC ..... 399/174, 176, 89
See application file for complete search history.

(56) References Cited

U.S. PATENT DOCUMENTS

| | | | | |
|---|---|---|---|---|
| 5,426,488 | A | 6/1995 | Hayakawa et al. | |
| 6,035,163 | A | 3/2000 | Zona et al. | |
| 6,360,065 | B1 | 3/2002 | Ishibashi et al. | |
| 6,389,255 | B1 | 5/2002 | Sawada et al. | |
| 6,405,006 | B1 | 6/2002 | Tabuchi | |
| 6,778,797 | B2 * | 8/2004 | Sato et al. | 399/176 |
| 6,807,389 | B2 | 10/2004 | Facci et al. | |
| 7,113,726 | B2 | 9/2006 | Tokumasu et al. | |
| 7,917,064 | B2 * | 3/2011 | Nagamori et al. | 399/176 |
| 8,346,132 | B2 * | 1/2013 | Sato | 399/176 |
| 8,663,748 | B2 * | 3/2014 | Akama et al. | 427/487 |
| 2011/0292149 | A1 * | 12/2011 | Hara | 347/104 |
| 2014/0037337 | A1 * | 2/2014 | Liu et al. | 399/176 |

OTHER PUBLICATIONS

U.S. Appl. No. 13/566,541, filed Aug. 3, 2012.

* cited by examiner

*Primary Examiner* — David Gray
*Assistant Examiner* — Carla Therrien
(74) *Attorney, Agent, or Firm* — Hoffman Warnick LLC

(57) ABSTRACT

There is described an image forming apparatus including an imaging member having a charge retentive-surface for developing an electrostatic latent image thereon, a substrate and a photoconductive member disposed on the substrate. A bias charge roller for applying an electrostatic charge on the charge retentive surface to a predetermined electric potential is included in the image forming apparatus. The bias charge roller includes a first circumferential area in contact with the photoconductive member ($CC_{[contact]}$), and a second circumferential area ($CC_{[non\text{-}contact]}$) spaced a distance of from 1 μm to 1 mm from the photoconductive member. The image forming apparatus includes a power supply for supplying an oscillating voltage signal to the bias charge roller wherein the oscillating voltage signal has a frequency $Am[f_{AC}]$ and an amplitude $Am[V_{AC}]$. The following relationship is met: $(CC_{[contact]}/CC_{[non\text{-}contact]}) \leq (Am[f_{AC}]/Am[V_{AC}]) \leq (CC_{[non\text{-}contact]}/CC_{[contact]})$ by the image forming apparatus.

17 Claims, 3 Drawing Sheets

SEMI-CONTACT BIAS CHARGE ROLLER

BACKGROUND

1. Field of Use

The present disclosure is directed to a bias charge roller that can be employed in an electrophotographic printing machine, photocopier, or a facsimile machine. In particular, the bias charge roller ("BCR") includes a continuously raised pattern to allow semi-contact with the photoreceptor.

2. Background

In electrophotography or electrophotographic printing, the charge retentive surface, typically known as a photoreceptor (P/R), is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used; however, contact type charging devices increase wear on the photoreceptor surface and decrease the life of a photoreceptor. The contact type charging device, also termed "bias charge roll" (BCR) includes a conductive member which is supplied a voltage from a power source with a D.C. voltage superimposed with an A.C. voltage of no less than twice the level of the D.C. voltage. The charging device contacts the image bearing member (photoreceptor) surface, which is a member to be charged. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

To further increase the service life of the photoreceptor, use of overcoat layers has also been implemented to protect photoreceptors and improve performance, such as wear resistance. However, these low wear overcoats are associated with poor image quality due to A-zone deletion in a humid environment as the wear rates decrease to a certain level. In addition, high torque associated with low wear overcoats in A-zone also causes severe issues with BCR charging systems, such as motor failure, blade damage and contamination on the BCR and the photoreceptor. As a result, use of a low wear overcoat with BCR charging systems is still a challenge, and there is a need to find ways to increase the life of the photoreceptor.

SUMMARY

Disclosed herein is an image forming apparatus that includes an imaging member having a charge retentive-surface for developing an electrostatic latent image thereon. The imaging member includes a substrate and a photoconductive member disposed on the substrate. A bias charge roller for applying an electrostatic charge on the charge retentive surface to a predetermined electric potential is included in the image forming apparatus. The bias charge roller includes a first circumferential area in contact with the photoconductive member ($CC_{[contact]}$), and a second circumferential area ($CC_{[non\text{-}contact]}$) spaced a distance of from 1 μm to 1 mm from the photoconductive member. The image forming apparatus includes a power supply for supplying an oscillating voltage signal to the bias charge roller wherein the oscillating voltage signal has a frequency $Am[f_{AC}]$ and an amplitude $Am[V_{AC}]$. The following relationship is met: $(CC_{[contact]}/CC_{[non\text{-}contact]}) \leq (Am[f_{AC}]/Am[V_{AC}]) \leq (CC_{[non\text{-}contact]}/CC_{[contact]})$ by the image forming apparatus.

Disclosed herein is a charging unit that includes a bias charge roller for applying an electrostatic charge on an imaging member having a charge retentive surface to a predetermined electric potential. The bias charge roller includes a first circumferential area in contact $CC_{[contact]}$ with the charge retentive surface and a second circumferential area $CC_{[non\text{-}contact]}$ spaced a distance of from 1 μm to 1 mm from the charge retentive surface. The charging unit includes a power supply for supplying an oscillating voltage signal to the bias charging roller wherein the oscillating voltage signal has a frequency $Am[f_{AC}]$ and an amplitude $Am[V_{AC}]$. The relationship; $(CC_{[contact]}/CC_{[non\text{-}contact]}) \leq (Am[f_{AC}]/Am[V_{AC}]) \leq (CC_{[non\text{-}contact]}/CC_{[contact]})$ is met by the charging unit.

Disclosed herein is an image forming apparatus including an electrophotographic imaging member having a charge retentive surface configured to receive an electrostatic latent image. The image forming apparatus includes a development component to apply developer material to the charge retentive surface to form a developed image on the charge retentive surface. The image forming apparatus includes a transfer component for transferring the developed image from the charge retentive surface to a substrate. The image forming apparatus includes a bias charge roller for applying an electrostatic charge on the charge retentive surface to a predetermined electric potential. The bias charge roller includes a first circumferential area in contact $CC_{[contact]}$ with the charge retentive surface and a second circumferential area $CC_{[non\text{-}contact]}$ spaced a distance of from about 1 μm to about 1 mm from the charge retentive surface. The image forming apparatus includes a power supply for supplying an oscillating voltage signal to the bias charge roller wherein the oscillating voltage signal has a frequency $Am[f_{AC}]$ and an amplitude $Am[V_{AC}]$. The relationship $(CC_{[contact]}/CC_{[non\text{-}contact]}) \leq (Am[f_{AC}]/Am[V_{AC}]) \leq (CC_{[non\text{-}contact]}/CC_{[contact]}$ is met by the image forming apparatus.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
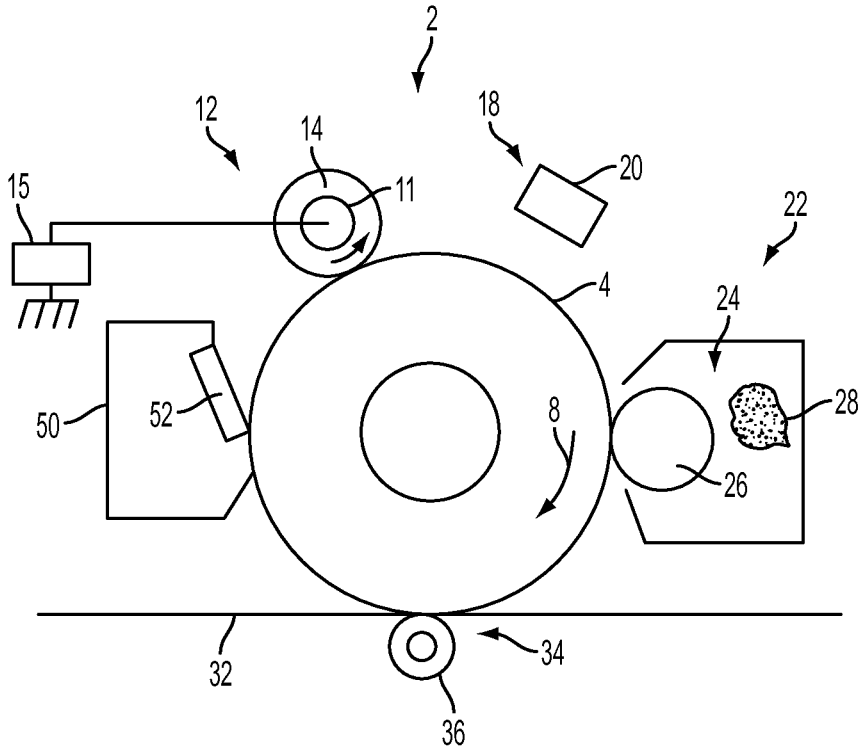
FIG. 1 schematically depicts the various components of an image forming apparatus incorporating a bias charge roller, according to an embodiment of the present disclosure.

FIG. 1 schematically depicts the various components of an electrophotographic imaging apparatus 2 incorporating a bias charge roller 14, according to an embodiment of the present disclosure, as will be discussed in greater detail below. The imaging apparatus 2 can be used in, for example, an electrophotographic printing machine, photocopier or facsimile machine. The bias charge roller 14 of the present disclosure is well suited for use in a wide variety of imaging apparatus and is not limited to the particular design of FIG. 1.

The imaging apparatus 2 employs an electrophotographic imaging member 4 having a charge-retentive surface, or photoreceptor, for receiving an electrostatic latent image. The electrophotographic imaging member or photoreceptor 4 can be in the form of a photoconductive drum as shown in FIG. 1, although imaging members in the form of a belt are also known, and may be substituted therefore. The photoreceptor 4 can rotate in the direction of arrow 8 to advance successive portions thereof sequentially through various processing stations disposed about the path of movement thereof.

Initially, successive portions of photoreceptor 4 pass through charging station 12. At charging station 12, bias charge roller 14 charges the photoreceptor 4 to a uniform electrical potential. Power to the bias charge roller 14 can be supplied by a suitable power control means. As will be described in greater detail below an electrically conductive, continuous raised pattern is positioned on the outer surface of the bias charge roller 14. The bias charge roller 14 is includes a metal core 11 to which a power supply unit 15 supplies DC (direct current) and AC (alternating current) biases both of which are constant-voltage-controlled. The DC and AC biases, however, may be constant-current-controlled. The DC and AC biases will be explained in more detail below. For a bias charging members in electrophotographic machines, the peak-to-peak value of the AC voltage is at least two times larger than the absolute value of the DC voltage for a required uniform charging on the photoreceptor.

After rotating through charging station 12, the photoreceptor 4 passes through an imaging station 18. Imaging station 18 can employ a suitable photo imaging technique to form an electrostatic latent image on the surface of photoreceptor 4. Any suitable imaging technique can be employed. One example of a well known imaging technique employs a ROS (Raster Optical Scanner) 20. The ROS 20 may include a laser for radiating the photoreceptor 4 to form the electrostatic latent image thereon.

In an embodiment, the imaging apparatus 2 may be a light lens copier. In a light lens copier a document to be reproduced can be placed on a platen located at the imaging station. The document can be illuminated in known manner by a light source, such as a tungsten halogen lamp. The document thus exposed is imaged onto the photoreceptor 4 in any suitable manner, such as by using a system of mirrors, as is well known in the art. The optical image selectively discharges the photoreceptor 4 in an image configuration whereby an electrostatic latent image of the original document is recorded on the photoreceptor 4 at the imaging station.

Following imaging station 18, photoreceptor 4 rotates though a development station 22. At development station 22, a developer unit 24 advances developer materials into contact with the electrostatic latent image to thereby develop the image on the photoreceptor 4. The developer unit 24 can include a developer roller 26 mounted in a housing. The developer roller 26 advances developer materials 28 into contact with the latent image. Any suitable developer materials can be employed, such as toner particles. Appropriate developer biasing may be accomplished via a power supply (not shown), electrically connected to developer unit 24, as is well known in the art.

A substrate 32, which can be, for example, a sheet of paper or a surface of an intermittent transfer belt, is moved into contact with the toner image at transfer station 34. Transfer station 34 transfers the developer material image from the photoreceptor 4 to substrate 32. Any suitable transfer technique can be employed for accomplishing this task. For example, transfer station 34 can include a second bias charge roller 36, which applies ions of a suitable polarity onto the backside of substrate 32. This attracts the developer material image from the photoreceptor 4 to substrate 32.

After the image is transferred to substrate 32, the residual developer material 28 carried by image and non-image areas on the photoconductive surface of the imaging member can be removed at cleaning station 50. Any technique for cleaning the photoconductive surface can be employed. For example, a cleaning blade 52 can be disposed at the cleaning station 50 to remove any residual developer material remaining on the photoconductive surface.

It is believed that the foregoing description is sufficient for purposes of the present disclosure to illustrate the general operation of an imaging apparatus as used in an electrophotographic printing machine incorporating the development apparatus of the present invention therein.

Bias Charge Rollers (BCRs) have been used as the major charging apparatus in xerographic systems. At present, most BCRs are in direct contact with the photoreceptor but some manufacturers use a non-contact type. The contact BCR suffers from waste toner contamination over many print cycles and increases the wear rate of the P/R, reducing overall service life of BCR. The non-contact BCR addresses these issues but demands other engineering trade-offs, such as unstable charging uniformity with less robust gap control over the entire service life of the BCR and significantly increased AC voltage which increases the wear rate of P/R.

Figure 2A:
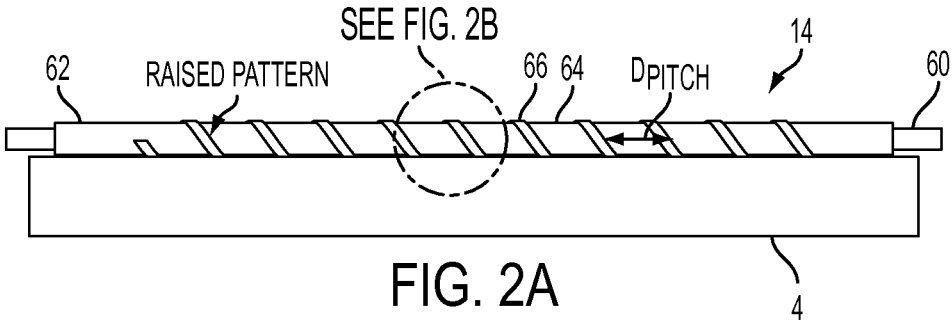
FIGS. 2A and 2B illustrate a semi-contact bias charge roller, according to an embodiment of the present disclosure.
Figure 2B:
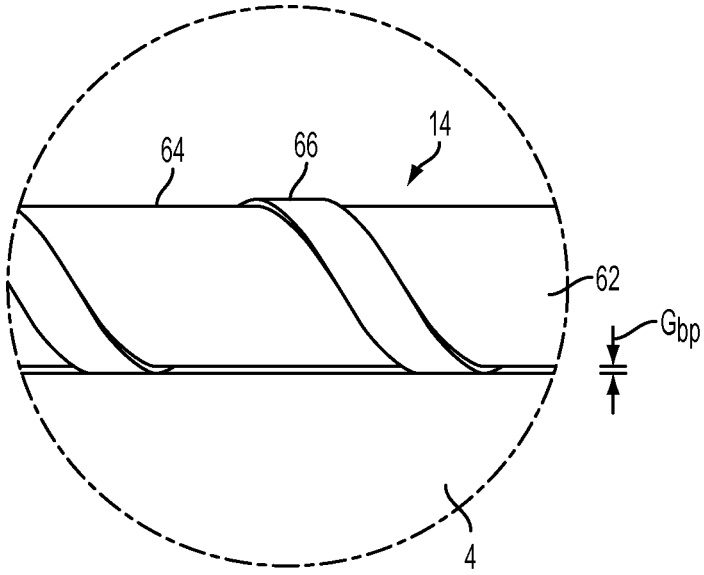

As described in U.S. Ser. No. 13/566,541, incorporated in its entirety by reference herein, FIGS. 2A and 2B illustrate a semi-contact bias charge roller 14. Bias charge roller 14 comprises an electrically conductive core 60. A roller member 62 surrounds the core 60 and is axially supported thereby. The roller member 62 can include one or more coatings configured to provide the desired electrical properties for biasing the photoreceptor 4, including a conductive or semi-conductive outer layer 64 and a raised pattern 66. Raised pattern 66 extends continuously around the longitudinal axis of the bias charge roller 14. There is a business need to establish new design concepts for BCR. The semi-contact BCR design of U.S. Ser. No. 13/566,541 reduces contact time and contact area between BCR and photoreceptor without affecting required knee AC voltage. Disclosed herein is improvement of the operation of the semi-contact BCR by relating AC voltage, AC frequency and the geometry of BCR. Disclosed herein is improved operation associated with such a semi-contact BCR.

In an embodiment, the raised pattern 66 can wrap around the longitudinal axis of the outer layer. For example, the raised pattern 66 can be wrapped in a coiled configuration, such as in the shape of a helix. The pitch of the coils, $D_{pitch}$, can be constant or varied; and can range from about 0.01 mm to about 10 cm, such as about 1 mm to about 6 cm, or about 1 cm to about 4 cm. A small $D_{pitch}$ may increase the complexity of making the bias charge roller 14. It may also undesirably increase the contact area between the bias charge roller 14 and the P/R. On the other hand, too large of a $D_{pitch}$ may cause reduced rigidity of the raised pattern to effectively make a gap.

Continuing with the general description of the semi-contact BCR shown in FIGS. 2A and 2B, the conductive core 60 supports the bias charge roller 14, and may generally be made up of any conductive material. Exemplary materials include aluminum, iron, copper, or stainless steel. The shape of the conductive core 60 may be cylindrical, tubular, or any other suitable shape.

The outer layer 64 that surrounds conductive core 60 is deformable to ensure close proximity or contact with the photoreceptor 4. In an alternative embodiment, a stiff, non-conformable outer layer 64 can be employed, as is well known in the art.

Where the outer layer 64 is deformable, layer 64 can include any suitable elastomeric polymer material. Examples of suitable polymeric materials include: neoprene, EPDM rubber, nitrile rubber, polyurethane rubber (polyester type), polyurethane rubber (polyether type), silicone rubber, styrene butadiene rubbers, fluoro-elastomers, VITON/FLUOREL rubber, epichlorohydrin rubber, or other similar materials.

The polymeric materials can be mixed with a conductive filler to achieve any desired resistivity. One of ordinary skill in the art would readily be able to determine a suitable resistivity for the outer layer 64. The amount of conductive filler to achieve a given resistivity may depend on the type of filler employed. As an example, the amount of filler may range from about 1 to about 30 parts by weight per 100 parts by weight of the polymeric material.

Examples of suitable conductive filler include carbon particles, graphite, pyrolytic carbon, metal oxides, ammonium perchlorates or chlorates, alkali metal perchlorates or chlorates, conductive polymers like polyaniline, polypyrrole, polythiophene, and polyacetylene, and the like.

The outer layer 64 may have any suitable thickness. For example, the thickness can range from about 0.1 mm to about 10 mm, such as from about 1 mm to about 5 mm, excluding the thickness of the raised pattern 66.

A low surface energy additive may be included in the outer layer 64. Examples of low surface energy additives include hydroxyl-containing perfluoropolyoxyalkanes such as FLUOROLINK® D (M.W. of about 1,000 and fluorine content of about 62 percent), FLUOROLINK® D10-H (M.W. of about 700 and fluorine content of about 61 percent), and FLUOROLINK® D10 (M.W. of about 500 and fluorine content of about 60 percent) ($—CH_2OH$); FLUOROLINK® E (M.W. of about 1,000 and fluorine content of about 58 percent) and FLUOROLINK® E10 (M.W. of about 500 and fluorine content of about 56 percent) ($—CH_2(OCH_2CH)_nOH$); FLUOROLINK® T (M.W. of about 550 and fluorine content of about 58 percent), and FLUOROLINK® T10 (M.W. of about 330 and fluorine content of about 55 percent) ($—CH_2OCH_2CH(OH)CH_2OH$); hydroxyl-containing perfluoroalkanes ($R^fCH_2CH_2OH$, wherein $R^f=F(CF_2CF_2)_n$) such as ZONYL® BA (M.W. of about 460 and fluorine content of about 71 percent), ZONYL® BA-L (M.W. of about 440 and fluorine content of about 70 percent), ZONYL® BA-LD (M.W. of about 420 and fluorine content of about 70 percent), and ZONYL® BA-N (M.W. of about 530 and fluorine content of about 71 percent); carboxylic acid-containing fluoropolyethers such as FLUOROLINK® C (M.W. of about 1,000 and fluorine content of about 61 percent); carboxylic ester-containing fluoropolyethers such as FLUOROLINK® L (M.W. of about 1,000 and fluorine content of about 60 percent) and FLUOROLINK® L10 (M.W. of about 500 and fluorine content of about 58 percent); carboxylic ester-containing perfluoroalkanes ($R^fCH_2CH_2O(C=O)R$, wherein $R^f=F(CF_2CF_2)_n$ and R is alkyl) such as ZONYL® TA-N (fluoroalkyl acrylate, $R=CH_2=CH—$, M.W. of about 570 and fluorine content of about 64 percent), ZONYL® TM (fluoroalkyl methacrylate, R=CH2=C(CH3)-, M.W. of about 530 and fluorine content of about 60 percent), ZONYL® FTS (fluoroalkyl stearate, $R=C_{17}H_{35}$, M.W. of about 700 and fluorine content of about 47 percent), ZONYL® TBC (fluoroalkyl citrate, M.W. of about 1,560 and fluorine content of about 63 percent); sulfonic acid-containing perfluoroalkanes ($R^fCH_2CH_2SO_3H$, wherein $R^f$=F $(CF_2CF_2)_n$) such as ZONYL® TBS (M.W. of about 530 and fluorine content of about 62 percent); ethoxysilane-containing fluoropolyethers such as FLUOROLINK® S10 (M.W. of about 1,750 to about 1,950); phosphate-containing fluoropolyethers such as FLUOROLINK® F10 (M.W. of about 2,400 to about 3,100); hydroxyl-containing silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, ZONYL® is a trademark of DuPont, and BYK-SILCLEAN® is a trademark of BYK. All percent concentrations listed herein above are percentages by weight of the relevant polymer, unless specified otherwise.

The outer layer can be either conductive or semi-conductive. In an embodiment, the conductivity of the outer layer 64 can be, for example, 100 S/cm or more. The surface resistivity of the outer layer 64 can be any suitable value that will provide good print quality. For example, surface resistivity can range from about $10^3$ ohm-m to about $10^{13}$ ohm-m at 20° C., or from about $10^4$ ohm-m to about $10^{12}$ ohm-m, or from about $10^5$ ohm-m to about $10^7$ ohm-m.

The outer layer 64 may be formed by any suitable conventional technique. Examples of suitable techniques include spraying, dip coating, draw bar coating, gravure coating, silk screening, air knife coating, reverse roll coating, vacuum deposition, chemical treatment, or a molding process.

The raised pattern 66 can be electrically conductive or semi-conductive and can comprise any suitable electrically conductive or semi-conductive material. Examples of suitable materials include metals, such as copper, copper alloys, aluminum, aluminum alloys, or conductive or semi-conductive polymers, such as ultra high molecular weight (UHMW) polyethylene or any of the other elastomers discussed herein for use in the outer layer. Raised pattern 66 can further include conductive fillers and/or low surface energy additives, as also listed above for outer layer 64.

Raised pattern 66 can be made of the same material or a different material as outer layer 64. In an embodiment, raised pattern 66 is formed as an integral part of outer layer 64, such as by using a molding process that forms both together. In other embodiments, raised pattern 66 can be formed separately from outer layer 64.

In an embodiment, the raised pattern 66 can wrap around the longitudinal axis of the outer layer. For example, the raised pattern 66 can be wrapped in a coiled configuration, such as in the shape of a helix.

As shown in FIG. 2B, raised pattern 66 has a height that provides a desired gap, $G_{bp}$, between the bias charge roller 14 and the photoreceptor 4. During operation, the gap operates in a periodically non-contact mode to charge the photoreceptor. $G_{bp}$ can have any suitable value that will allow desired charging of the photoreceptor 4. Examples of suitable values range from about 1 micron to about 1000 microns, or about 10 microns to about 500 microns, or about 25 microns to about 100 microns.

Figure 3A:
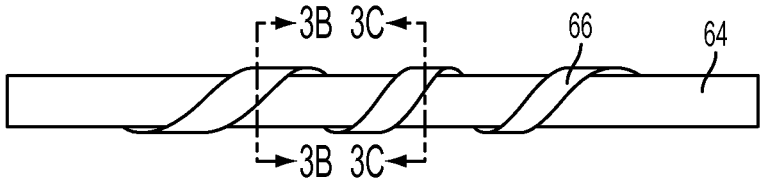
FIG. 3A illustrates a circumferential coverage area of a raised portion and a circumferential coverage area of a non-contact area of a bias charge roller, according to an embodiment of the present disclosure.
Figure 3B:
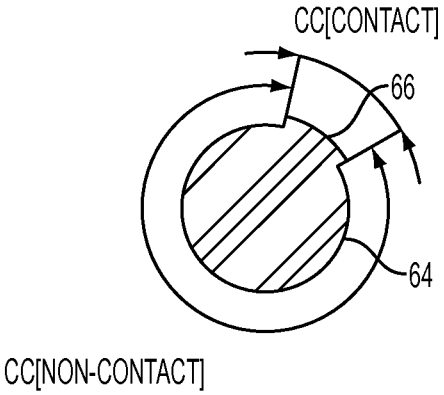
FIGS. 3B and 3C illustrate cross-sections of the circumferential coverage area of the raised portion and the circumferential coverage area of a non-contact area of the bias charge roller of FIG. 3A.
Figure 3C:
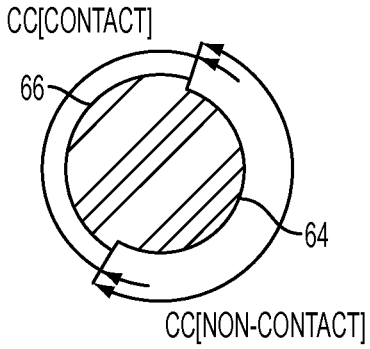

Defined herein is a ratio R of the "circumferential coverage (CC)" of contact area and non-contact area of the BCR:

$$R = \frac{CC[\text{Contact}]}{CC[\text{Non-contact}]}$$

where CC[Contact] is the circumferential coverage area of the raised portion (area of 66 in contact with the P/R), and CC[Non-Contact] is the circumferential coverage area of the non-contact area (area of 66) is the circumferential coverage area of the non-contact area, as shown in FIGS. 3A, 3B and 3C.

In operating a semi-contact BCR, correct design of R can minimize contact area (contact time for same speed) with the P/R. It has been determined that too large or too small of an R can result in an increase in the contact area. If the R is too large, it is straightforward to expect too much contact area; however, if the R is too small, the gap between non-contact area and P/R can not be effectively guaranteed. Exemplary R values range from about 0.08 to about 0.3, such as about 0.08 to about 0.2, or about 0.1 to about 0.2 were disclosed in U.S. Ser. No. 13/566,541. However, the effectiveness of charging a P/R surface is also dependent on the direct current and alternating current voltages.

The charging uniformity performance of a semi-contact BCR includes two areas, one is in direct contact with P/R; another is near the P/R surface separated by a tiny gap. To best perform uniform charging of the P/R, the ratio R, frequency and amplitude of AC voltages on BCR, must satisfy Equation 1:

$$\frac{CC[\text{Contact}]}{CC[\text{Non-contact}]} \le \frac{Am[f_{AC}]}{Am[V_{AC}]} \le \frac{CC[\text{Non-contact}]}{CC[\text{Contact}]} \qquad \text{Eq (1)}$$

$Am[f_{AC}]$ represents the frequency of the AC voltage in KHz. $Am[V_{AC}]$represents the amplitude of the AC voltage in kV. Equation 1 is independent of DC bias assuming 2*abs [DC bias]<$Am[V_{AC}]$. There is a strong dependence for required voltage amplitude $Am[V_{AC}]$ and frequency amplitude $Am[f_{AC}]$ of the AC voltage as a function of the ratio R as defined in Eq. (1). Determining the optimal balance of AC voltage amplitude and frequency results in stable charging with the semi-contact BCR. A balance between amplitude (strength) and frequency (period) of AC field is necessary to pull and push generated ions which compensates for the periodic variation of the gap between the contact and non-contact portions of the BCR with the P/R surface. Although a full theory is not offered here, our testing results are shown in Table 1.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

A series of semi-contact BCRs for charging a photoreceptor were made, similar to that shown in FIGS. 2A and 2B. The semi-contact BCRs had R values of 0 (no contact), 0.3, 0.4, 0.5, 0.6, 0.7, 1, infinite (BCR with no raised surface). The BCR 14 contacted a photoreceptor 4 as shown in FIG. 1. The semi-contact BCRs included a spirally wound conductive outer layer made by wrapping copper tape around a BCR with a thickness of about 13.8 mm. The spiral angle was about 45°.

The BCRs as prepared were installed on an 84 mm UDS testing fixture for charging performance. A fresh 84 mm Xerox commercial P/R drum was used for this test with rotation speed set as 3 rps. At the same time, we also prepared a contact BCR, and a contactless BCR including spacers made of copper tape with thickness ~50 μm at each end to ensure the same gap as the semi-contact BCR.

The electrical parameters in this test were $V_{DC}$=−0.7 kV. The Am[$f_{AC}$] was varied from 0.2 to 3.7 kHz. The amplitude of the alternating voltage, Am[$V_{AC}$], was varied from 0.7 to 1.5 kV. The charging uniformity was determined and is summarized Table 1.

TABLE 1

| | | R = 0.5 | R = 0.4 | R = 0.6 | R = 0.3 | R = 0.7 | R = 1 | R = 0 | R = infinite |
|---|---|---|---|---|---|---|---|---|---|
| V(amplitude) = 0.7 kV | f = 0.2 kHz | BAD | BAD | BAD | BAD | BAD | BAD | | |
| | f = 0.5 kHz | GOOD | GOOD | GOOD | GOOD | GOOD | BAD | | |
| | f = 1.0 kHz | GOOD | GOOD | GOOD | GOOD | GOOD | BAD | | |
| | f = 1.2 kHz | GOOD | GOOD | GOOD | GOOD | GOOD | BAD | | |
| | f = 1.3 kHz | GOOD | GOOD | GOOD | GOOD | GOOD | GOOD | | |
| | f = 1.4 kHz | BAD | GOOD | GOOD | GOOD | GOOD | BAD | | |
| | f = 1.5 kHz | BAD | GOOD | GOOD | GOOD | GOOD | BAD | | |
| | f = 1.7 kHz | BAD | GOOD | GOOD | GOOD | GOOD | BAD | GOOD | GOOD |
| | f = 1.8 kHz | BAD | BAD | BAD | GOOD | GOOD | BAD | | |
| | f = 2.0 kHz | BAD | BAD | BAD | GOOD | GOOD | BAD | | |
| | f = 2.2 kHz | BAD | BAD | BAD | GOOD | GOOD | BAD | | |
| | f = 2.5 kHz | BAD | BAD | BAD | BAD | BAD | BAD | | |
| | f = 3.5 kHz | BAD | BAD | BAD | BAD | BAD | BAD | | |
| | f = 3.7 kHz | BAD | BAD | BAD | BAD | BAD | BAD | | |
| V(amplitude) = 0.95 kV | f = 0.2 kHz | BAD | BAD | BAD | BAD | BAD | BAD | | |
| | f = 0.5 kHz | GOOD | BAD | GOOD | GOOD | GOOD | BAD | | |
| | f = 0.8 kHz | GOOD | GOOD | GOOD | GOOD | GOOD | BAD | | |
| | f = 1 kHz | GOOD | GOOD | GOOD | GOOD | GOOD | BAD | | |
| | f = 1.2 kHz | GOOD | GOOD | GOOD | GOOD | GOOD | BAD | GOOD | GOOD |
| | f = 1.95 kHz | GOOD | GOOD | GOOD | GOOD | GOOD | GOOD (Fair) | | |
| | f = 2.1 kHz | BAD | GOOD | GOOD | GOOD | GOOD | BAD | | |
| | f = 2.3 kHz | BAD | GOOD | BAD | GOOD | GOOD | BAD | | |
| | f = 3.1 kHz | BAD | BAD | BAD | GOOD | GOOD | BAD | | |
| | f = 3.5 kHz | BAD | BAD | BAD | BAD | BAD | BAD | | |
| V(amplitude = 13 kV | f = 0.2 Hz | BAD | BAD | BAD | BAD | BAD | BAD | | |
| | f = 0.5 kHz | BAD | BAD | BAD | GOOD | GOOD | BAD | | |
| | f = 0.7 kHz | BAD | GOOD | GOOD | GOOD | GOOD | BAD | | |
| | f = 0.8 kHz | GOOD | GOOD | GOOD | GOOD | GOOD | BAD | | |
| | f = 1 kHz | GOOD | GOOD | GOOD | GOOD | GOOD | BAD | | |
| | f = 1.2 kHz | GOOD | GOOD | GOOD | GOOD | GOOD | BAD | GOOD | GOOD |
| | f = 2 kHz | GOOD | GOOD | GOOD | GOOD | GOOD | BAD | | |
| | f = 2.5 kHz | BAD | GOOD | GOOD | GOOD | GOOD | BAD | | |
| | f = 2.8 kHz | BAD | GOOD | GOOD | GOOD | GOOD | GOOD (Fair) | | |
| | f = 3.0 kHz | BAD | BAD | BAD | GOOD | GOOD | BAD | | |
| | f = 3.5 kHz | BAD | BAD | BAD | GOOD | GOOD | BAD | | |
| V(amplitud) = 1.5 kV | f = 0.2 Hz | BAD | BAD | BAD | BAD | BAD | BAD | | |
| | f = 0.5 kHz | BAD | BAD | BAD | BAD | BAD | BAD | | |
| | f = 0.7 kHz | BAD | BAD | BAD | BAD | BAD | BAD | | |
| | f = 0.8 kHz | BAD | BAD | BAD | BAD | BAD | BAD | | |
| | f = 1 kHz | BAD | BAD | BAD | BAD | BAD | BAD | | |
| | f = 1.2 kHz | GOOD | GOOD | GOOD | GOOD | GOOD | BAD | | |
| | f = 2 kHz | GOOD | GOOD | GOOD | GOOD | GOOD | BAD | GOOD | GOOD |
| | f = 2.5 kHz | GOOD | GOOD | GOOD | GOOD | GOOD | BAD | | |
| | f = 2.8 kHz | GOOD | GOOD | GOOD | GOOD | GOOD | BAD | | |
| | f = 3.0 kHz | GOOD | GOOD | GOOD | GOOD | GOOD | BAD | | |
| | f = 3.1 kHz | BAD | GOOD | GOOD | GOOD | GOOD | GOOD (Fair) | | |
| | f = 3.2 kHz | BAD | GOOD | GOOD | GOOD | GOOD | BAD | | |
| | f = 3.5 kHz | BAD | BAD | BAD | GOOD | GOOD | BAD | | |

By correctly setting the AC amplitude and AC frequency, the P/R could be stably charged with optimal performance using a semi-contact BCR. Not wishing to be bound by theory, it is postulated that a good balance between amplitude (strength) and frequency (period) of AC field to pull and push generated ions compensates for the periodic changing of the gap between non-contact part and contact part of the BCR in relation to the surface of the P/R. Table 1 show that. We found that such dependence can be well described by:

$$\mathrm{Min}\left[\frac{CC[\text{Contact}]}{CC[\text{Non-contact}]}, \frac{CC[\text{Non-contact}]}{CC[\text{Contact}]}\right] \leq \frac{Am[f_{AC}]}{Am[V_{AC}]} \leq \mathrm{Max}\left[\frac{CC[\text{Contact}]}{CC[\text{Non-contact}]}, \frac{CC[\text{Non-contact}]}{CC[\text{Contact}]}\right] \quad \text{Equation (2)}$$

Equation 2 correlated properties of electrical voltages on a semi-contact BCR.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. An image forming apparatus comprising:

a) an imaging member having a charge retentive-surface for developing an electrostatic latent image thereon, wherein the imaging member comprises:
a substrate, and
a photoconductive member disposed on the substrate;

b) a bias charge roller for applying an electrostatic charge on the charge retentive surface to a predetermined electric potential wherein the charging unit comprises a first circumferential area in contact with the photoconductive member ($CC_{[contact]}$) and a second circumferential area ($CC_{[non\text{-}contact]}$) spaced a distance of from about 1 μm to about 1 mm from the photoconductive member; and c) a power supply for supplying an oscillating voltage signal to the bias charge roller wherein the oscillating voltage signal has a frequency $Am[f_{AC}]$, measured in kHz, and an amplitude $Am/V[_{AC}]$, measured in kV, wherein a relationship $(CC_{[contact]}/CC_{[non\text{-}contact]}) \leq (Am[f_{AC}]/Am[V_{AC}]) \leq (CC_{[non\text{-}contact]}/CC_{[contact]})$ is met.

2. The image forming apparatus according to claim 1, wherein the oscillating voltage signal is biased by a DC offset with a value of the absolute value of [DC bias], measured in kV.

3. The image forming apparatus according to claim 2, wherein the absolute value of [DC bias]$<Am[V_{AC}]$.

4. The image forming apparatus according to claim 1, wherein $CC_{[contact]} < CC_{[non\text{-}contact]}$.

5. The image forming apparatus of claim 1, wherein $CC_{[contact]}/CC_{[non\text{-}contact]}$ ranges from about 0.08 to about 0.3.

6. The image forming apparatus of claim 1, wherein a surface resistivity of the bias charge roller ranges from about $10^3$ ohm-m to about $10^{13}$ ohm-m.

7. A charging unit comprising:

a bias charge roller for applying an electrostatic charge on an imaging member having a charge retentive surface to a predetermined electric potential, wherein the bias charge roller comprises a first circumferential area in contact ($CC_{[contact]}$) with the charge retentive surface and a second circumferential area $CC_{[non\text{-}contact]}$ spaced a distance of from about 1 μm to about 1 mm from the charge retentive surface; and a power supply for supplying an oscillating voltage signal to the bias charge roller wherein an oscillating voltage signal has a frequency $Am[f_{AC}]$, measured in kHz, and an amplitude $Am[V_{AC}]$, measured in kV, wherein a relationship $(CC_{[contact]}/CC_{[non\text{-}contact]}) \leq (Am[f_{AC}]/Am[V_{AC}]) \leq (CC_{[non\text{-}contact]}/CC_{[contact]})$ is met.

8. The charging unit according to claim 7, wherein the oscillating voltage signal is biased by a DC offset with a value of the absolute value of [DC bias], measured in kV.

9. The charging unit according to claim 7, wherein the absolute value of [DC bias]$<Am[V_{AC}]$.

10. The charging unit according to claim 7, wherein $CC_{[contact]}/CC_{[non\text{-}contact]}$ ranges from about 0.08 to about 0.3.

11. The charging unit of claim 7, wherein a surface resistivity of the bias charge roller ranges from about $10^3$ ohm-m to about $10^{13}$ ohm-m.

12. An image forming apparatus comprising:

an electrophotographic imaging member having a charge retentive surface configured to receive an electrostatic latent image;

a development component to apply developer material to the charge retentive surface to form a developed image on the charge retentive surface;

a transfer component for transferring the developed image from the charge retentive surface to a substrate;

a bias charge roller for applying an electrostatic charge on the charge retentive surface to a predetermined electric potential wherein the bias charge roller comprises a first circumferential area in contact $CC_{[contact]}$ with the charge retentive surface and a second circumferential area $CC_{[non\text{-}contact]}$ spaced a distance of from about 1 μm to about 1 mm from the charge retentive surface; and a power supply for supplying an oscillating voltage signal to the bias charge roller wherein the oscillating voltage signal has a frequency $Am[f_{AC}]$, measured in kHz, and an amplitude $Am[V_{AC}]$, measured in kV, wherein a relationship $(CC_{[contact]}/CC_{[non\text{-}contact]}) \leq (Am[f_{AC}]/Am[V_{AC}]) \leq (CC_{[non\text{-}contact]}/CC_{[contact]})$ is met.

13. The image forming apparatus according to claim 12, wherein the oscillating voltage signal is biased by a DC offset with a value of the absolute value of [DC bias], measured in kV.

14. The image forming apparatus according to claim 13, wherein the absolute value of [DC bias]$<Am[V_{AC}]$.

15. The image forming apparatus according to claim 12, wherein $CC_{[contact]} < CC_{[non\text{-}contact]}$.

16. The image forming apparatus of claim 12, wherein $CC_{[contact]}/CC_{[non\text{-}contact]}$ ranges from about 0.08 to about 0.3.

17. The image forming apparatus of claim 12, wherein a surface resistivity of the bias charge roller of ranges from about $10^3$ ohm-m to about $10^{13}$ ohm-m.

* * * * *